US005911269A

United States Patent [19]

Brander et al.

[11] Patent Number: 5,911,269

[45] Date of Patent: Jun. 15, 1999

[54] METHOD OF MAKING SILICA SAND MOLDS AND CORES FOR METAL FOUNDING

[75] Inventors: John J. Brander, Milwaukee; Ronald M. Kotschi, Wauwatosa, both of Wis.

[73] Assignee: Industrial Gypsum Co., Inc., Milwaukee, Wis.

[21] Appl. No.: 08/716,955

[22] Filed: Sep. 20, 1996

Related U.S. Application Data

[63] Continuation-in-part of application No. 08/384,477, Feb. 1, 1995, abandoned, which is a continuation of application No. 07/976,907, Nov. 16, 1992, abandoned.

[51] Int. Cl.[6] ..... B22C 1/02

[52] U.S. Cl. ..... 164/523; 106/38.2; 106/38.3; 106/38.9; 164/529

[58] Field of Search ..... 164/15, 523, 529; 106/38.2, 38.9, 38.3

[56] References Cited

U.S. PATENT DOCUMENTS

| | | | |
|---|---|---|---|
| 4,131,476 | 12/1978 | Melcher et al. | 106/38.9 X |
| 4,735,973 | 4/1988 | Brander | 523/139 |
| 4,897,294 | 1/1990 | Libby et al. | 164/529 X |
| 5,057,155 | 10/1991 | Nakayama et al. | 106/35 |

FOREIGN PATENT DOCUMENTS

| | | | |
|---|---|---|---|
| 372016 | 3/1973 | U.S.S.R. | 164/529 |
| 1031631 | 7/1983 | U.S.S.R. | 164/523 |

OTHER PUBLICATIONS

Spodumene, Technical Data Bulletin, 313–A, published by Foote Mineral Company.

*Primary Examiner*—J. Reed Batten, Jr.
*Attorney, Agent, or Firm*—Andrus, Sceales, Starke & Sawall

[57] ABSTRACT

Thermal expansion defects, i.e. veining, are reduced in iron, steel, and nonferrous castings by adding a lithia-containing material in a sufficient amount to the silica sand mold to provide about 0.001% to about 2.0% of lithia. The addition of lithia is accomplished by adding lithium bearing minerals such as α-spodumene, amblygonite, montebrasite, petalite, lepidolite, zinnwaldite, eucryptite or lithium carbonate.

14 Claims, 1 Drawing Sheet

FIG. 1
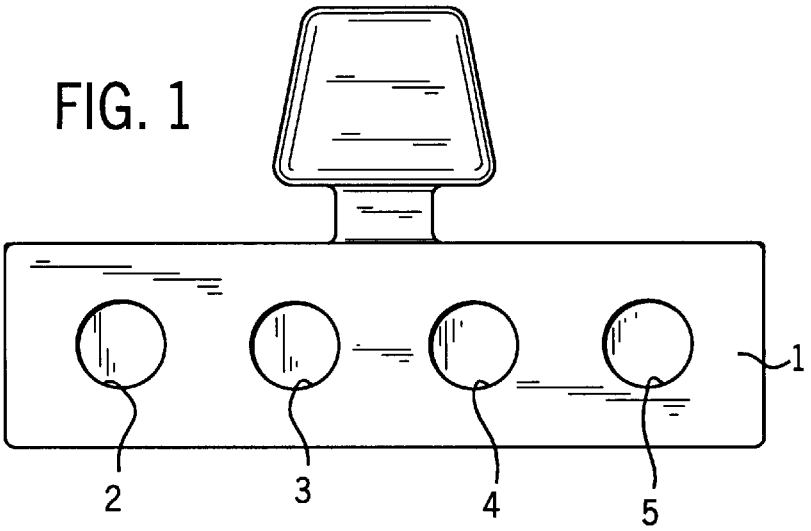
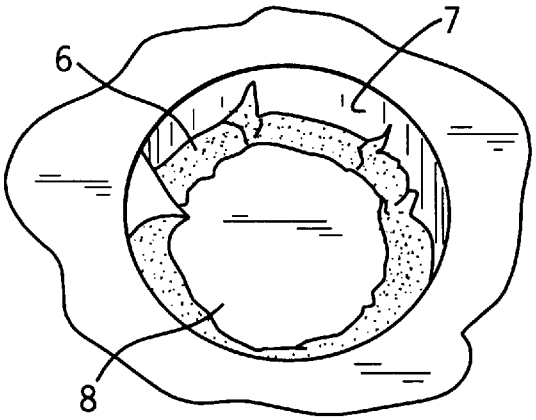
FIG. 2
FIG. 3
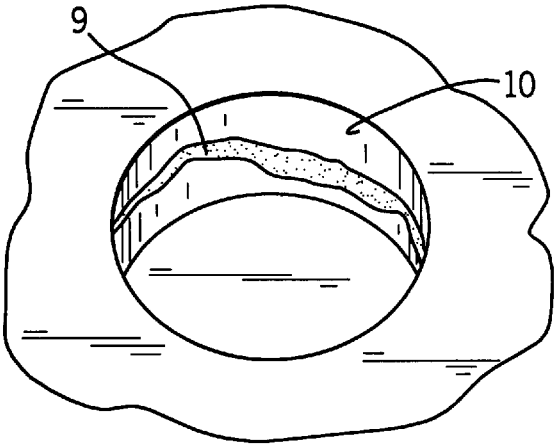
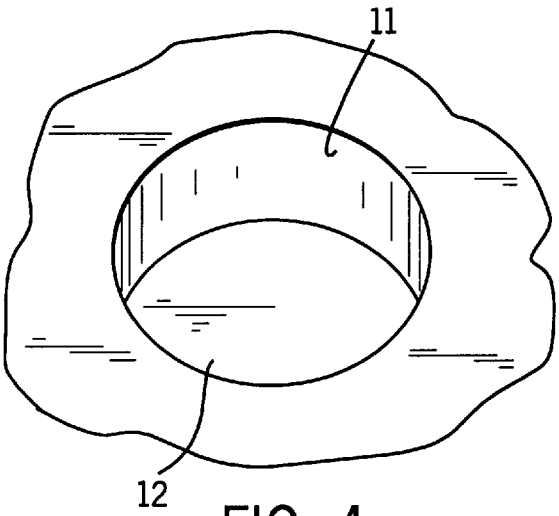
FIG. 4

METHOD OF MAKING SILICA SAND MOLDS AND CORES FOR METAL FOUNDING

CROSS REFERENCE TO RELATED APPLICATIONS

This application is a continuation-in-part of Ser. No. 08/384,477 filed Feb. 1, 1995, now abandoned, which in turn is a continuation of Ser. No. 07,976,907 filed Nov. 16, 1992, now abandoned.

BACKGROUND OF THE INVENTION

The present invention relates to metal founding, and more particularly to a method of making a sand-based mold which improves the quality of castings by reducing veining defects, and to the metal casting prepared by said method.

Iron oxides have been used for years in foundry applications to improve core properties and the quality of castings. Iron oxides have proven to be advantageous as an additive to foundry molding aggregates containing silica sand to improve the quality of castings by reducing the formation of thermal expansion defects, such as veining, scabs, buckles, and rat tails as well as gas defects, such as pinholes and metal penetration. There are several iron oxides which are currently used in foundries today. These include red iron oxide, also known as hematite ($Fe_2O_3$), black iron oxide, also known as magnetite ($Fe_3O_4$) and yellow ochre. Another iron oxide which is presently being used is Sierra Leone concentrate which is a hematite ore black in color. Red iron oxide and black iron oxide are the most popular iron oxides in use.

The currently accepted method of employing the above iron oxides is to add approximately 1–3% by weight to the sand mold aggregates during mixing. The exact mechanism by which iron oxides affect surface finish is not totally understood. However, it is generally believed that the iron oxides increase the hot plasticity of the sand mixture by the formation of a glassy layer between the sand grains which deforms and "gives", without fracturing at metallurgical temperatures, to prevent fissures from opening up in the sand, which in turn reduces veining.

Various other types of additives have also been employed in an attempt to improve core properties and the quality of sand castings. For example, other anti-veining compounds which have been utilized in sand aggregate mixtures include starch based products, dextrin, fine ground glass particles, red talc and wood flour i.e. particles of wood coated with a resin. All of these additives have met with limited success in reducing veining.

Currently, minerals containing lithia are utilized in the glass, glaze, and enamel industries as a fluxing agent. Also, in Nakayama et al, U.S. Pat. No. 5,057,155 a lithium mineral is added to a mold-forming composition to function as an expansive agent during heating and firing of ceramic molds used in the investment casting industry. According to Nakayama et al, the mold-forming composition irreversibly expands during firing of the mold in proportion to the amount of lithium mineral present to provide dimensional accuracy for castings by compensating for solidification shrinkage which occurs during cooling of poured metals such as titanium and the like used, for example, in dental castings.

It should be noted that additives containing lithia have not been added to sand-based foundry molding and core aggregates. Nakayama et al fails to provide any motivation to one skilled in the art to use a lithia-containing compound such as α-spodumene as an anti-veining agent in sand-based foundry molding and core mixtures. First, one would not expect α-spodumene to work in silica sand-based aggregates because: (a) α-spodumene expands upon heating and curing of the mold slurry as taught in Nakayama et al; and (b) in silica sand-based molds expansion of the mold is undesirable since an expanded sand mold would create cracks. Thus, one would expect veining to actually be enhanced rather than reduced if an agent that expands upon heating was used in a silica sand mold. Second, one would not expect α-spodumene to be effective in sand castings due to its relatively low melting temperature. In other words, since a-spodumene melts at a temperature less than the pouring temperature of the metal, no one would want to add such a material to silica sand castings since it would be expected that such a material would melt and thus change its form and shape during pouring. Third, the composition of Nakayama et al is a slurry rather than a discrete shape. Clearly, as a slurry, it could not be employed to process a mold for any sand casting operation. These slurries, once fired and turned into a ceramic mold, the mold composition has been transformed and no longer contains α-spodumene but instead contains β-spodumene which is totally different in crystal structure. The use of lithium-containing minerals, such as a-spodumene, for a lithia source as an additive to sand-based foundry aggregates thus is a unique application.

SUMMARY OF THE INVENTION

The present invention relates to a method of making silica sand mold and core aggregates utilizing lithium-containing additives. The lithium containing additive provides a source of lithia ($Li_2O$). The additive is mixed with foundry sand molding and core aggregates used in the production of cores and molds to improve the quality of castings by reducing thermal expansion defects i.e. veining, in iron, steel, and non-ferrous castings.

In one aspect, the invention relates to a foundry molding and core silica sand mixture used to produce cores and molds comprising about 80% to about 99% of commonly used molding and core silica sand together with about 0.5% to about 10.0% of a binder appropriate or sand cores and molds, and a lithia-containing additive of sufficient amount to provide about 0.001% to about 2.0% of lithia ($Li_2O$). The lithia-containing additive is preferably selected from lithia-containing materials consisting of α-spodumene, amblygonite, montebrasite, petalite, lepidolite, zinnwaldite, eucryptite, and lithium carbonate. Each of these materials provides a source of lithium oxide ($Li_2O$) commonly referred to as lithia. Sizing of these minerals should be 90% retained by passing a 40 mesh screen.

In another aspect, the invention relates to a method of making a silica sand foundry molding and core mixture used to produce sand cores and molds comprising the steps of preparing an aggregate of sand and resin binder, and formulating a lithium-containing additive in the aggregate of a sufficient amount to provide about 0.001% to about 2.0% of lithia in the aggregate. The formulating step preferably comprises adding lithia selected from the group consisting of α-spodumene, amblygonite, montebrasite, petalite, lepidolite, zinnwaldite, eucryptite, and lithium carbonate.

The addition to foundry molding and core aggregates of lithia significantly reduces the casting defects associated with the thermal expansion of silica and dramatically improves the surface finish of such castings. A major cause of veining occurs when silica sand is rapidly heated causing the silica ($SiO_2$) to undergo a rapid expansion allowing the hot metal to penetrate into the fissure caused by the silica expansion. The addition of lithia improves the resulting casting quality. The reaction of lithia in the form of α-spodumene with silica to control silica expansion is as follows:

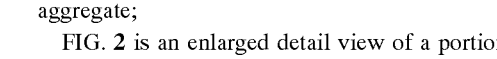

$$Li_2O.Al_2O_3.4SiO_2+4SiO_2 \rightarrow Li_2O.Al_2O_3.8SiO_2.$$

The free silica is thus absorbed into beta spodumene which has extremely low thermal expansion. If using lithia from the mineral group defined above, these materials must be in the α-phase.

As a result, it is not necessary to surface grind the casting to remove any projecting veins. This results in a significant reduction in the cost of the casting. Also, some foundries have sprayed solutions containing zircon or graphite onto the exterior surfaces of cores and molds in order to improve the appearance of castings. With the addition of lithia to the silica sand aggregate, this graphite or zircon solution may no longer be necessary as the use of lithia in the aggregate substantially improves the surface appearance of the casting.

BRIEF DESCRIPTION OF THE DRAWINGS

In the drawings:

FIG. 1 is a plan view of a test casting made from a sand aggregate;

FIG. 2 is an enlarged detail view of a portion of the test casting of FIG. 1 illustrating a veining defect;

FIG. 3 is an enlarged detail view similar to FIG. 2 illustrating another type of veining defect; and FIG. 4 is an enlarged detail view of a portion of a test casting illustrating the beneficial results of the use of lithia in the sand aggregate.

DETAILED DESCRIPTION OF THE INVENTION

An additive to foundry sand molding and core aggregates is used to produce sand cores and molds. The additive produces a sand-based foundry molding and core aggregate which resists the formation of some of the defects commonly associated with the production of castings produced by silica sand-based molding and core aggregates. In particular, the additive improves the quality of castings by reducing thermal expansion defects, i.e. veining, in iron, steel and non-ferrous castings.

The additive of the present invention may be utilized with conventional foundry silica sand molding and core aggregates used in the manufacture of sand-based molds and cores. Such mold and core aggregates are usually made from silica sand, with the sand grains being bound together with a mechanical or chemical means. Typically, the mold or core mixture may comprise between about 80% to about 99% of silica sand, and about 0.5% to about 10% of a binder. The binder used may be any of numerous conventional core and mold binder systems such as phenolic hot box, phenolic urethane, furan, sodium silicate including ester and carbon dioxide system, polyester binders, acrylic binders, alkaline binders, epoxy binders, and furan warm box systems. Each of the above binder systems is well known in the art and therefore a detailed description thereof is unnecessary.

The additive of the present invention is a lithia-containing additive added in a sufficient amount to the aggregate to provide about 0.001% to about 2.0% of lithium oxide ($Li_2O$) commonly referred to as lithia. With less than about 0.001% lithia, the additive becomes less effective resulting in a significant increase in veining and metal penetration. The addition of lithia to the aggregate is accomplished by adding lithia from a material selected from the group consisting of α-spodumene, amblygonite, montebrasite, petalite, lepidolite, zinnwaldite, eucryptite or lithium carbonate. Each of these materials is a lithia source and may be employed depending upon the particular sand-based aggregate and binder system being utilized. All of the above-described lithia sources are commercially available and typically contain about 3% to about 10% lithia with the exception of lithium carbonate which has about 40% lithia.

FIG. 1 illustrates a typical gray iron test casting having a main body 1 with four recesses 2–5 formed therein. FIG. 2 illustrates a typical veining defect 6 located at the intersection of side wall 7 and bottom 8 that might occur in one of recesses 2–5. FIG. 3 illustrates a second type of veining defect 9 that may occur in side wall 10 in one of recesses 2–5. Finally, FIG. 4 illustrates the improved surface finish of wall 11 and bottom 12 that might occur in one of recesses 2–5 due to the use of lithia in a silica sand aggregate.

The test results of several experimental trials of the use of the lithia additive, herein called "Veinseal", a trademark of Industrial Gypsum Co., Inc., as well as other known additives, added to resin bonded silica sand molding and core aggregates are given in the following experiments and tables.

EXPERIMENT 1

Different silica sand-based aggregates were prepared for the purpose of evaluating various additives for veining effects. Accordingly, identical silica sand-based aggregate mixes were prepared utilizing eight different additives which were formulated with the silica sand containing mixture at 5% based on sand (B.O.S.) and 10% B.O.S. levels. Identical silica sand mixtures were prepared utilized 1.3% of a phenolic urethane type resin binder. Resulting test castings were made like those illustrated in FIG. 1 and were evaluated for the ability of each additive to control veining in the test castings. The additives were (1) lithospar G which is an aluminosilicate in granular form; (2) lithospar P which is an aluminosilicate in powder form; (3) α-spodumene which is a lithia aluminosilicate; (4) amblygonite which is a lithia aluminophosphate; (5) F-20 which is a soda feldspar; (6) K-40 which is potassium feldspar; (7) aplite which is a fine grained granite rock consisting almost entirely of quartz and feldspar; and (8) G-40 which is potassium feldspar in powder form. A comparison of the test castings showed that the best additives were α-spodumene and amblygonite at the 5% B.O.S. and 10% B.O.S. levels. These two additives eliminated veining in the test castings. In contrast, the other materials did not eliminate veining at the same levels. A comparison of the composition of each material was made and is shown in Table 1. Upon comparing the ingredients of the various additives utilized it was noted that the only significant difference between α-spodumene and amblygonite from the other additives was that each of these two materials contained a much greater percentage of lithia, or lithium oxide ($Li_2O$). As a result of this experiment, it was decided to further investigate the possible effect of lithia on veining defects.

TABLE 1

COMPARISON OF DIFFERENT AGGREGATES FOR VEINING

| | LITHO-SPAR G | LITHO-SPAR P | SPODU-MENE | AMBLY-GONITE | F-20 | K40 | APLITE | G-40 |
|---|---|---|---|---|---|---|---|---|
| $SiO_2$ | 81.5 | 81.5 | 6.5 | 43 | 68 | 67.1 | 63.6 | 67.3 |
| $Al_2O_3$ | 10.94 | 11 | 26.9 | 29.8 | 19 | 18.3 | 22 | 18 |
| $Fe_2O_3$ | 0.06 | 0.06 | 0.064 | 0.1 | 0.075 | 0.07 | 0.1 | 0.1 |
| $Na_2O$ | 4.65 | 4.65 | 0.19 | 0.1 | 7.15 | 3.8 | 6 | 2.85 |
| $K_2O$ | 2.5 | 2.5 | 0.11 | 0.2 | 3.75 | 10.1 | 2.6 | 10.5 |
| MgO | TR | TR | TR | TR | TR | TR | TR | 0.36 |
| CaO | 0.2 | 0.2 | TR | TR | 1.85 | 0.36 | 5.5 | 1.02 |
| $Li_2O$ | 0.15 | 0.15 | 7.43 | 7.75 | 0 | 0 | 0 | 0 |
| $P_2O_5$ | 0 | 0 | 0 | 20.1 | 0 | 0 | 0 | 0 |

EXPERIMENT 2

Several experimental trials of the use of an additive, herein called "Veinseal", as well as other known additives, added to phenolic resin bonded silica sand molding and core aggregates are given in Table 2. The purpose of this experiment was to evaluate Veinseal 12000, which is a combination of 88% α-spodumene and 12% black iron oxide, and cullet which is ground silica glass to determine the better additive of the two for purposes of eliminating veining. Veinseal 12000 and cullet were both run at various percent resin binder and weight percent B.O.S., as shown in Table 2. The cores were tested for veining and penetration at an iron temperature of 2,687° F. The test castings were grey iron and the iron was poured for 20.62 seconds. The cores were dipped in Satin Kote 40 at 37 baume. The oven temperature was 250° F. Satin Kote 40 is a standard cosmetic coating applied on the core to provide a smooth looking finish, and is a standard coating typically applied in the silica sand casting industry. The ratings provided in Table 2 are based on visual observations of the surface finish, and the lower the number the better or more improved quality of the casting. The ratings are based on the following legend:

0 No Veining/No Penetration

1 Slight Veining And/Or Slight Penetration 2 25% Of Core Area Contains Veining And/Or Penetration 3 50% Of Core Area Contains Veining And/Or Penetration 4 75% Of Core Area Contains Veining And/Or Penetration 5 Massive Veining And/Or Penetration The results in Table 2 favor Veinseal 12000 at 1.5% resin binder and 7% B.O.S. of the additive. The study indicates that as the percentage of Veinseal 12000 is added to the mixture, veining and penetration is reduced. Also, the test results in Table 2 clearly show that Veinseal 12000 is significantly more effective than cullet. It should further be noted that the additives shown in Table 2 are ranked in order from best to worst, i.e. Veinseal 12000 at 1.5% resin and 7% B.O.S. was the best performing additive whereas cullet at 1.5% resin and 5% B.O.S. was the worst.

TABLE 2

PENETRATION/VEINING COMPARISON
CULLET VS. VEINSEAL 12000
RANK (BEST TO WORST)

| Additive | Resin Binder (%) | Amount of Additive (% B.O.S.) | Penetration | # of Veins |
|---|---|---|---|---|
| 1. Veinseal 12000 | 1.5 | 7 | 3 | 0 |
| 2. Veinseal 12000 | 1.5 | 5 | 3 | 1 |
| 3. Cullet | 1.3 | 1 | 2 | 4 |
| 4. Veinseal 12000 | 1.5 | 3 | 4 | 3 |
| 5. Cullet | 1.4 | 3 | 5 | 3 |
| 6. Cullet | 1.5 | 5 | 4 | 5 |

POURING TIME: 20.62 seconds
POURING TEMP: 2687° F.
SATIN KOTE 40, BAUME 37 @ 250° F.

EXPERIMENT 3

The purpose of this experiment was to evaluate five different anti-veining agents. The agents are (1) Delta AVC which is an anti-veining compound composed mostly of wood flour i.e. small particles of wood or wood dust coated with a resin; (2) red talc which is a magnesium tetrasilicate mineral; (3) Veinseal 11000 which was a "placebo" or control additive comprising cornstarch and contained no lithia; (4) Veinseal 12000 which was 88% a-spodumene and 12% black iron oxide; and (5) cutlet which is ground silica glass. The five anti-veining agents were evaluated at various percentages based on sand for veining effects on grey iron test castings. The amount of resin in each sand batch was held constant at 1.5% resin. After the cores were shaped and released from a cold box, the cores were dipped and coated with Satin Kote 40 at 36 baume, and then dried in a 250° F. oven. The cores were then reviewed for an evaluation of veining. The iron was poured for 26.22 seconds and the iron temperature was 2,621° F. The test results were repeated twice and are shown in Table 3. The ratings are visual observations and are based upon the legend described in Experiment 2. The additives are ranked from best to worst. Veinseal 12000 was found to be the most effective in reducing veining.

TABLE 3

VEINING EVALUATING
ANTI-VEINING AGENTS
NUMBER OF VEINS (BEST TO WORST)

| Additive | Amount of Additive (% B.O.S.) | Number of Veins TEST #1 | Number of Veins TEST #2 |
|---|---|---|---|
| 1. Veinseal 12000 | 5 | 2 | 1 |
| 2. AVC | 1 | 6 | 3 |
| 3. Veinseal 11000 | 1 | 7 | 3 |
| 4. Cullet | 2 | 2 | 8 |
| 5. Cullet | 1 | 6 | 7 |
| 6. Red Talc | 1 | 8 | 8 |

POURING TIME: 26.22 seconds @ 2621° F.

EXPERIMENT 4

The purpose of this experiment was to evaluate the effectiveness of Veinseal 12000 and a modified version of Veinseal 12000 referred to as Veinseal 12000 EXP. Veinseal 12000 EXP is a combination of 78% α-spodumene, 10% lithium carbonate ($LiCO_3$) and 12% black iron oxide. Identical sand batches were prepared utilized "Isocure" binder which is a phenolic urethane binder. In each test, 1.5% resin was employed, and the amount of additive varied as shown in Tables 4A and 4B. The tests were run in two different molds to see if the type of mold had any effect on the additive's performance.

After the cores were released from the cold box, cores were dipped and dried (Satin Kote 40, baume 40) at 250° F., and a veining and penetration evaluation with iron temperature of 2706° F. for mold number 1 and 2658° F. for mold number 2 was performed. The evaluation is based on visual observations according to the legend described in Experiment 2. The results shown in Tables 4A and 4B illustrate that the best performing additive was Veinseal 12000 EXP at 3% B.O.S. The veining was eliminated in both tests as illustrated in Tables 4A and 4B. It should also be noted from the data shown with respect to additives 5 and 6, as the amount of lithia decreases, veining in the castings increases.

TABLE 4A

VEINING/PENETRATION COMPARISON
"ISOCURE" - ANTI-VEIN AGENTS
MOLD #1

| Additive | Resin Binder (%) | Amount Of Additive (% B.O.S.) | Pene-tration | # Of Veins |
|---|---|---|---|---|
| 1. Veinseal 12000 EXP | 1.5 | 5 | 2 | 0 |
| 2. Veinseal 12000 | 1.5 | 3 | 4 | 0 |
| 3. Veinseal 12000 EXP | 1.5 | 5 | 4 | 0 |
| 4. Veinseal 12000 EXP | 1.5 | 5 | 3 | 1 |
| 5. Veinseal 12000 EXP | 1.5 | 1 | 1 | 4 |
| 6. Veinseal 12000 EXP | 1.5 | 1 | 5 | 5 |

IRON TEMP. 2706° F.
SATIN KOTE 40, BAUME 40 @ 250° F.

TABLE 4B

VEINING/PENETRATION COMPARISON
"ISOCURE" - ANTI-VEIN AGENTS
MOLD #2

| Additive | Resin Binder (%) | Amount Of Additive (% B.O.S.) | Pene-tration | # Of Veins |
|---|---|---|---|---|
| 1. Veinseal 12000 EXP | 1.5 | 3 | 0 | 0 |
| 2. Veinseal 12000 | 1.5 | 5 | 1 | 0 |
| 3. Veinseal 12000 EXP | 1.5 | 5 | 2 | 0 |
| 4. Veinseal 12000 EXP | 1.5 | 3 | 1 | 1 |
| 5. Veinseal 12000 EXP | 1.5 | 5 | 1 | 2 |
| 6. Veinseal 12000 EXP | 1.5 | 1 | 4 | 4 |

IRON TEMP. 2658° F.
SATIN KOTE 40, BAUME 40 @ 250° F.

EXPERIMENT 5

The purpose of this experiment was to evaluate Veinseal 12000 EXP at various resin levels and at various additive levels.

As a result, numerous grey iron test castings were produced utilizing a silica sand and phenolic urethane binder mix with the variations and the resin levels indicated in Table 5. Veinseal 12000 EXP was also formulated in the mix at the various weight percent B.O.S. shown in Table 5. After the cores were released from a cold box, cores were dipped and dried (Satin Kote 40, Baume 40, at 250° F.) and a veining and penetration evaluation was performed with iron temperature of 2600° F. The evaluation of veining and penetration was made visually according to the legend described in Experiment 2. The results indicate that Veinseal 12000 EXP at 1.5% resin and 3% B.O.S. showed the best results.

TABLE 5

VEINING/PENETRATION COMPARISON
VEINSEAL 12000 EXP
VEINING PENETRATION OVERALL (BEST TO WORST)

| Additive | Resin Binder (%) | Amount Of Additive (% B.O.S.) | Penetration | # Of Veins |
|---|---|---|---|---|
| 1. | 1.5 | 3 | 2 | 1 |
| 2. | 1.5 | 3 | 2 | 2 |
| 3. | 1.7 | 2 | 2 | 3 |
| 4. | 1.5 | 2 | 4 | 3 |
| 5. | 1.7 | 2 | 4 | 4 |
| 6. | 1.5 | 2 | 3 | 6 |

IRON TEMPERATURE: 2600° F.
SATIN KOTE 40, BAUME 37 @ 250° F.

EXPERIMENT 6

The purpose of the following experiment was to test Veinseal 12000, Veinseal 11000 and an additive called "Veino Plus" for sand performance and casting properties. Veino Plus is a cornstarch additive. The basic sand mixture was identical in all four mixes with the variable being the additive formulated therein. Grey iron test castings were poured at 2600° F., and casting grades shown in Table 7 were as follows: 1=Excellent; 2=Good; 3=Fair; 4=Poor; and 5=Very Poor. The results are shown in Table 6, and as illustrated therein Veinseal 12000 minimized veining.

TABLE 6

TEST VEINSEAL 12,000, 11,000, AND VEINO PLUS FOR SAND PERFORMANCE AND CASTING PROPERTIES

| | | | |
|---|---|---|---|
| MIX 1: | SAND: | BADGER 5574 | OF LAB STD. |
| | PART 1: | ISOCURE 354 | LAB STD. 1.5% 35/65 RATIO |
| | PART 2: | ISOCURE 657 | LAB MADE |
| | ADDITIVE: | NONE | |
| MIX 2: | SAND: | BADGER 5574 | OF LAB STD. |
| | PART 1: | ISOCURE 354 | LAB STD. 1.5% 35/65 RATIO |
| | PART 2: | ISOCURE 657 | LAB MADE |
| | ADDITIVE: | VEINO PLUS | 1% B.O.S. |
| MIX 3: | SAND: | BADGER 5574 | OF LAB STD. |
| | PART 1: | ISOCURE 354 | LAB STD. 1.5% 35/65 RATIO |
| | PART 2: | ISOCURE 657 | LAB MADE |
| | ADDITIVE: | VEIN SEAL 11000 | 1.0% B.O.S. |
| MIX 4: | SAND: | BADGER 5574 | OF LAB STD. |
| | PART 1: | ISOCURE 354 | LAB STD. 1.5% 35/65 RATIO |
| | PART 2: | ISOCURE 657 | LAB MADE |
| | ADDITIVE: | VEIN SEAL 12000 | 5.0% B.O.S. |

| RESULTS: | MIX 1 | MIX 2 | MIX 3 | MIX 4 |
|---|---|---|---|---|
| VEINING | 2.5 | 2 | 1 | 1.5 |
| PENETRATION | 4.5 | 4 | 3 | 4 |

EXPERIMENT 7

In the following various sand mixes were prepared utilizing a phenolic urethane resin binder and different additives. The amount of resin binder varied as did the amount of additive. The results are shown in Table 7. In these results, the length of the veins formed in the test castings were measured and totaled so that the final column in Table 7 indicates a measurement of the total length of all veins formed in the test casting. As shown in Table 8, Macor, a starch based additive typically used to minimize veining, has a total vein formation length of 4.0 inches. Improvement over this is shown by Mix 4, 5, 9 and 10. With respect to Mix 2, 3 and 4, it should be noted that the amount of additive indicated was comprised of 1.75% Veinseal EXP and 0.25% graphite. With respect to Mix 5, the additive comprised 3.75% Veinseal EXP and 0.25% fumed silica. Larpen carbon is essentially graphite.

TABLE 7

| Mix # | Resin Binder (%) | Amount Of Additive (% B.O.S.) | Additive | Total Length Of Veins (Inches) |
|---|---|---|---|---|
| 1 | 1.25 | 1.0 | MACOR (STANDARD) | 4.0 |
| 2 | 1.25 | 2.0 | 12000 EXP + 26 GRAPHITE | 6.8 |
| 3 | 1.25 | 2.0 | 12000 EXP + 35 GRAPHITE | 9.0 |
| 4 | 1.25 | 2.0 | 12000 EXP + FUMED SILICA | 3.9 |
| 5 | 1.25 | 4.0 | 12000 EXP + FUMED SILICA | 0 |
| 6 | 1.25 | 2.0 | 12000 EXP. | 5.6 |
| 7 | 1.0 | 1.0 | 12000 EXP. | 6.0 |
| 8 | 1.25 | 1.5 | 12000 EXP. + LARPEN CARBON 1.0% | 5.2 |
| 9 | 1.0 | 3.0 | 12000 | 0.2 |
| 10 | 1.25 | 3.0 | 12000 EXP. + LARPEN CARBON 1.0% | 1.5 |

The above experiments illustrate the results of adding a lithium bearing material to the sand aggregate mix, and clearly demonstrates that the use of lithium oxide ($Li_2O$) commonly referred to as "lithia" reduces and substantially eliminates veining defects in iron, steel and nonferrous castings. The above test results from numerous independent experiments was found to corroborate this finding.

We claim:

1. A method of making a silica sand-based foundry mold or core comprising the steps of:

preparing a sand-based aggregate of silica sand, binder and a lithia-containing material; and shaping said sand-based aggregate to form a sand mold or a sand core having a desired pattern therein.

2. The method of claim 1 wherein said silica sand comprises from about 80% to about 90% of said aggregate.

3. The method of claim 1 wherein said lithia-containing material provides from about 0.001% to about 2.0% of lithia.

4. The method of claim 1 wherein said lithia-containing material comprises a mineral selected from the group consisting of α-spodumene, amblygonite, montebrasite, petalite, lepidolite, zinnwaldite, eucryptite and lithium carbonate.

5. The method of claim 4 wherein said preparing includes adding a metal oxide.

6. The method of claim 5 wherein said metal oxide is black iron oxide.

7. The method of claim 1 wherein said lithia-containing material comprises a combination of α-spodumene and lithium carbonate.

8. The method of claim 1 wherein said lithia-containing material comprises a combination of α-spodumene and black iron oxide.

9. A method of making a metal casting from silica sand-based foundry molds and cores comprising the steps of preparing a sand-based aggregate of silica sand, binder appropriate for sand molds, and a lithia-containing additive, said lithia-containing additive in said sand-based aggregate of sufficient amount to provide about 0.001% to about 2.0% of lithia in said sand-based aggregate;

shaping said sand-based aggregate to form a sand mold having a desired pattern therein; and pouring molten metal into the pattern formed in said sand-based aggregate to produce a metal casting.

10. The method of claim 9 wherein said lithia-containing additive comprises a mineral selected from the group consisting of α-spodumene, amblygonite, montebrasite, petalite, lepidolite, zinnwaldite, eucryptite and lithium carbonate.

11. The method of claim 9 wherein said preparing further includes adding a metal oxide.

12. The method of claim 11 wherein said metal oxide is black iron oxide.

13. The method of claim 9 wherein said lithia-containing additive comprises a combination of α-spodumene and lithium carbonate.

14. The method of claim 9 wherein said lithia-containing additive comprises a combination of α-spodumene and black iron oxide.

* * * * *